US008414338B2

(12) United States Patent
Reibke et al.

(10) Patent No.: US 8,414,338 B2
(45) Date of Patent: Apr. 9, 2013

(54) ELECTRIC CONNECTION TERMINAL FOR GUIDING A CIRCUIT THROUGH A WALL

(75) Inventors: Heinz Reibke, Bad Salzuflen (DE); Dennis Sprenger, Horn-Bad Meinberg (DE); Wjatscheslaw Janzen, Detmold (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 13/143,647

(22) PCT Filed: Jan. 5, 2010

(86) PCT No.: PCT/EP2010/000020
§ 371 (c)(1), (2), (4) Date: Oct. 13, 2011

(87) PCT Pub. No.: WO2010/079122
PCT Pub. Date: Jul. 15, 2010

(65) Prior Publication Data

US 2012/0052715 A1 Mar. 1, 2012

(30) Foreign Application Priority Data

Jan. 6, 2009 (DE) ..... 10 2009 004 136

(51) Int. Cl.
*H01R 9/22* (2006.01)

(52) U.S. Cl.
USPC ..... 439/715

(58) Field of Classification Search ..... 439/715, 439/716, 908
See application file for complete search history.

(56) References Cited

U.S. PATENT DOCUMENTS

| | | | | |
|---|---|---|---|---|
| 5,658,172 | A * | 8/1997 | Schmidt et al. | 439/716 |
| 7,658,653 | B2 * | 2/2010 | Diekmann et al. | 439/715 |
| 7,862,389 | B2 * | 1/2011 | Pizzi | 439/715 |
| 2005/0202718 | A1 | 9/2005 | Monte et al. | |

FOREIGN PATENT DOCUMENTS

DE 36 13 681 6/1987

OTHER PUBLICATIONS

Anonym: "High VoltageHochstrom-Durchfuhrungsklemmen"; Phoenix Contact Technische Daten, Apr. 15, 2003; URL: http://www.onlinecomponents.com/productfiles/mf-PH/phoenix_0717238.3.

International Search Report; PCT/EP2010/000020; Int'l File Date: Jan. 5, 2010; Applicant: Phoenix Contact GmbH & Co. KG, 3 pages.

* cited by examiner

*Primary Examiner* — Phuong Dinh
(74) *Attorney, Agent, or Firm* — Schmeiser, Olsen & Watts, LLP

(57) ABSTRACT

The invention relates to an electric connector terminal for guiding a circuit through a wall (1), having a first terminal (2) to be mounted at a side of the wall and a second terminal (3) to be mounted at the other side of the wall (1), with the first terminal (2) comprising a connector element (4) to connect to the second terminal (3), the connector element (4) can be inserted into the second terminal (3), the second terminal (3) comprising a power line (6) for the electric connection to the first terminal (2), the power line (6) can be inserted into the connector element (4), and the surface of the connector element (4) facing away from the power line (6) comprising a creepage power extension (10). The creepage power extension (10) according to the invention increases the creepage distance, so that the electric connector terminal according to the invention can be impinged with higher voltages.

11 Claims, 2 Drawing Sheets

ELECTRIC CONNECTION TERMINAL FOR GUIDING A CIRCUIT THROUGH A WALL

FIELD OF TECHNOLOGY

Figure 1:
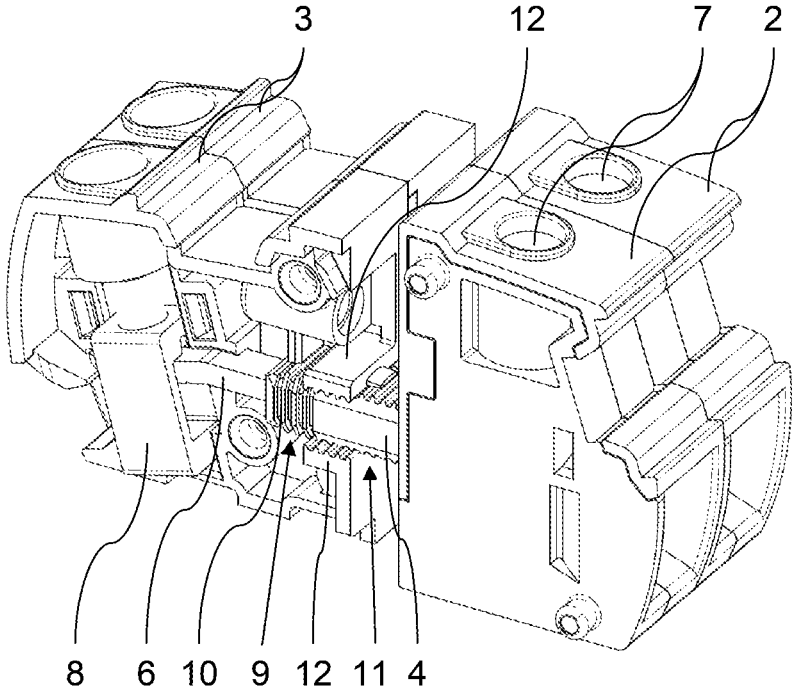

The following relates to an electric connection terminal for guiding a circuit through a wall, having a first terminal to be mounted at one side of the wall and a second terminal to be mounted at the other side of the wall.

BACKGROUND

In various applications, such as industrial connection technology, electric connection terminals are of great importance, and serve, for example, for connecting electric components. Electric connection terminals of the type in question have been developed preferably for devices with closed housings and are known as so-called lead-through terminals to guide a circuit through a wall of the housing.

Lead-through terminals are known from prior art, in which the first terminal contacts an interior area of the housing as the interior terminal and the second terminal an exterior area of the housing as the exterior terminal. Further, lead-through terminals are known from prior art, in which an insulating part provided at the inside of the wall counteracts the exterior terminal. Frequently, the interior terminal and/or the exterior terminal comprise a screwed connector, a connection pin, a soldering connection, a blade terminal, or a coil connector to contact the circuit.

The known, above-explained lead-through terminals are primarily used for measuring and control circuits, namely for maximally 660 V and 20 A. Higher voltages and/or currents require a considerable enlargement of the terminals in order to achieve the required air and creepage distances required by standards.

Such lead-through terminals known from prior art that can be used for higher voltages, such as 1000 V, require an extremely expensive production process, though and they cannot be used universally due to their considerably increased volumes of the terminals.

Accordingly, the objective of the invention is to provide a compact electric connection terminal for guiding a circuit through a wall, which can be used for high voltages and/or high currents.

SUMMARY

This objective is attained in an electric connection terminal for guiding a circuit through a wall, having a first terminal to be mounted at one side of the wall and a second terminal to be mounted at the other side of the wall, with the first terminal comprising a connection element to connect to the second terminal, the connection element can be inserted into the second terminal, the second terminal comprising a power line for the electric connection to the first terminal, the power line can be inserted into the connection element, and the surface of the connection element facing away from the power line comprising a creepage power extension.

According to the invention, this represents such an electric connection terminal for guiding a circuit through a wall, which can be used for higher voltages, such as 1000 V, without the volume of the terminals being enlarged in reference to embodiments known in prior art for electric connection terminals. Due to the fact that the surface facing away from the power line comprises a creepage power extension, the electric connection terminal according to the invention allows the guidance of higher voltage, such as 1000 V, through a wall while complying with statutory air and creepage distances, such as discernible from the standard IEC 60947-7-1/DIN EN 60664-1/VDE0110-1.

Preferably the entire surface of the connection element facing away from the power line, i.e. the surface of the connection element not facing the power line, is embodied as the creepage power extension. Here, the surface of the creepage power extension according to the invention shows a greater creepage distance than a surface of the connection element without any creepage power extension, such as particularly a surface with a planar form. Further, it is preferred that the power line is embodied as a power bar, with the connection element preferably comprising an insulating material. Further, it is preferred that the first terminal can be fastened at an interior side of the wall as an interior terminal and the second terminal at the outside of the wall as an exterior terminal. The creepage power extension according to the invention can particularly extend the creepage distance of the creepage power flowing between the power line and the wall. Here, the wall may comprise for example a metallic, i.e. conductive material, and represent a part of a housing, such as an electric installation box or a control box.

In principle, the creepage power extension may be embodied arbitrarily with regards to geometry. According to the invention it is provided, though that the creepage power extension shows an alternating tongue and groove structure and/or a tooth-like structuring of the surface of the connection element facing away from the power line. Further, it is preferred that the creepage power extension shows a rigid structuring and/or a rib-like structuring. Such a creepage power extension increases the creepage distance so that the electric connection terminal according to the invention can be impinged with higher voltages.

Further it is provided that the ratio of the depth of the groove to the height of the tongue of the alternating groove-like and tongue-like structuring in a frontal section of the connection element is greater than in a rear section of the connection element. Here, the frontal section of the connection element can be inserted deeper into the second terminal than the rear section of the connection element. Such an embodiment allows that the area of the connection element inserted farthest into the second terminal increases the creepage distance of the creepage current in reference to the area of the connection element inserted into the second terminal to a lesser extent.

According to another preferred embodiment of the invention at least the frontal section of the connection element is inserted into the second terminal when the first and second terminal are connected to each other. In other words, a creepage current can only flow between the power line and the wall on the surface of the frontal section of the connection element facing away from the power line, with the frontal section of the connection element showing a creepage power extension. In this context, according to a further development of the invention, it is preferred that in the frontal section of the connection element the entire surface of the connection element facing away from the power line comprises an alternating tongue and groove-like structuring. In other words, the connection element comprises at least in the frontal section an alternating circumferential tongue and groove-like structure, which covers the surface of the connection element facing away from the power line.

According to another preferred embodiment of the invention the second terminal comprises a snap element to interlock the connection element, with the snap element counteracting the connection element and the snap element being arranged in the area of the second terminal adjacent to the wall. Such an embodiment allows that on the one hand the connection element is guided by the snap element when connected with the second terminal, and on the other hand the terminal with the second terminal can be snapped via the snap element to the connection element.

According to a preferred further development of the invention, it is further provided that the connection element can be inserted at least partially into the snap element in the area of the wall. In other words, it is preferred that the snap element is not only arranged in the area adjacent to the wall of the second terminal but also at least partially or entirely projects from the second terminal in the area of the wall. Such an embodiment allows a further extension of the creepage distance because the creepage distance is extended in addition to the creepage power extension by the length of the snap element projecting into the area of the wall.

Furthermore, according to a further development of the invention it is particularly preferred that in case of the first terminal and the second terminal being connected the frontal section of the connection element being inserted via the snap element into the second terminal such that only the rear section of the connection element at least partially contacts the snap element. In other words, it is therefore preferred that not the frontal section of the connection element contacts the snap element but the rear section of the connection element contacts the snap element at least partially. Due to this feature according to the invention it can be achieved that the creepage distance is extended because the creepage power extension according to the invention, which is preferably provided at the frontal section of the connection element, is introduced via the snap element into the second terminal when the first and second terminals are connected to each other.

In principle, the snap element can be embodied arbitrarily. According to a preferred further development of the invention is it provided, though that the surface of the snap element facing the inserted connection element at least partially comprises an alternating tongue and groove like structure, and the tongue and/or the groove of the snap element contact correspondingly the tongue and/or groove of the rear section of the connection element. This way, the connection element can be inserted into the second terminal comprising the snap element such that the snap element interlocks with the rear section of the connection element via the corresponding tongues and/or grooves.

In principle, the connection element may show an arbitrary profile. According to a preferred further development of the invention it is provided, though that the connection element shows a rectangular profile. Furthermore, it is preferred that the connection element shows a tubular profile. In this context, it is further preferred that the power line shows a rectangular profile so that the connection element can contact the power line in a form-fitting manner. Additionally, it is preferred that the snap element can enter a form-fitting connection with the connection element.

According to a preferred further development of the invention it is further provided that the first terminal comprises a first connection body, the second terminal comprises a second connection body, the power line being connected in a fixed manner to the first connection body or to the second connection body, and the power line being connected to the second connection body or to the first connection body, respectively, in a detachable fashion. Furthermore, in this context it is preferred that a detachable connection of the power line to the first connection body and/or the second connection body can be created by way of clamping.

In principle, the first connector and/or the second connector may be embodied as spring-loaded connectors or as connector pins of any type. According to a preferred further development of the invention it is provided, though that the first connector and/or the second connector are embodied as screwed connectors. Here, the sizing of the first connector, the second connector, and/or the power line may occur based on currents and/or voltages expected.

BRIEF DESCRIPTION

Figure 2:
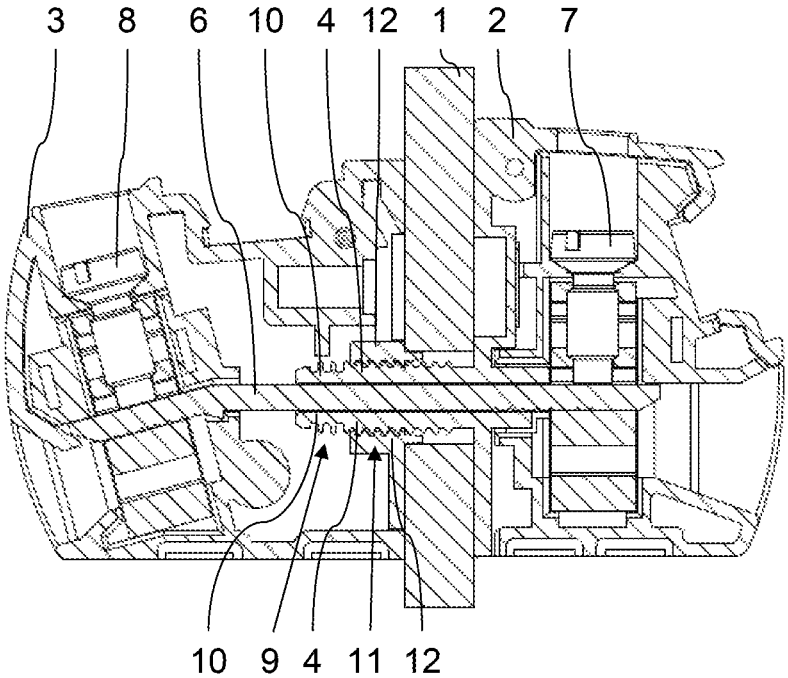
Figure 3:
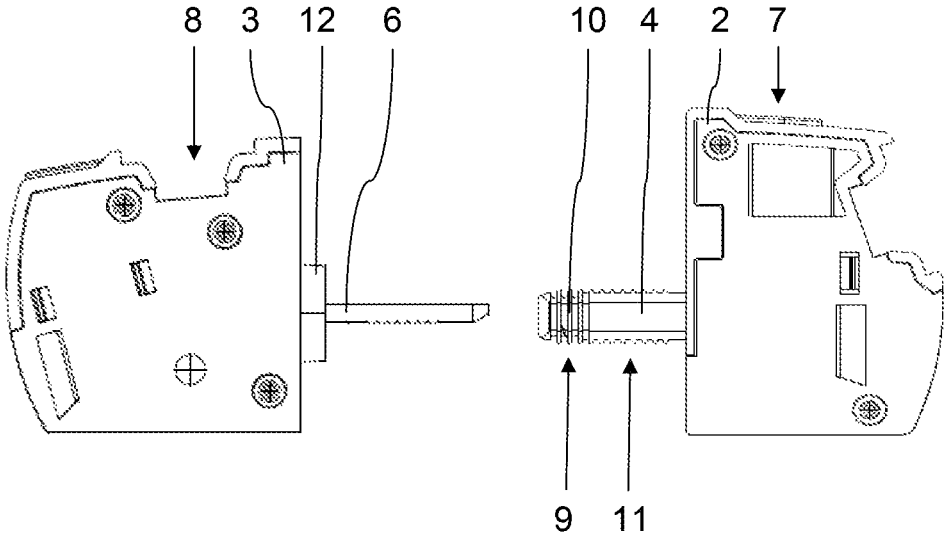

In the following, the invention is explained in detail with reference to the drawing. The drawing shows:

FIG. 1 an electric connector terminal in a plugged-in state according to a preferred exemplary embodiment of the invention in a perspective view, FIG. 2 an electric connector terminal in the plugged-in state according to the preferred exemplary embodiment of the invention in a cross-section, and FIG. 3 an electric connector terminal in the un-plugged state according to another preferred exemplary embodiment of the invention in a cross-section.

DETAILED DESCRIPTION

From FIG. 1 through FIG. 3 an electric connector terminal is discernible to guide a circuit through a wall 1 having a first terminal 2 to be mounted at a side of the wall 1 and a second terminal 3 to be mounted at the other side of the wall 1. In general, the second terminal 3 is fastened at an interior side of the wall 1 as the interior terminal and the first terminal 2 at an exterior side of the wall 1 as the exterior terminal, however, it is preferred to arrange the first terminal 2 as the interior terminal at an interior side of the wall 1 and the second terminal 3 as the exterior terminal at an exterior side of the wall 1. The wall 1 can represent, for example, a metallic wall 1 of an electric installation box or a control box.

According to the preferred exemplary embodiment of the invention the first terminal 2 comprises a connector element 4 to connect to the second terminal 3. When the first terminal 2 and the second terminal 3 are connected, as discernible from FIG. 2, the connector element 4 is inserted into the second terminal 3. Additionally, the power line 6, as discernible from FIG. 3, arranged at the second terminal 3, is inserted in a form-fitting fashion into the connector element 4 in the first terminal 2. The power line 6, which may be embodied as a metallic power bar, allows an electric connection between a first connector 7 allocated to the first terminal 2 and a second connector 8 allocated to the second terminal 3. As discernible from the figures, the first connector 7 and the second connector 8 may be embodied as screwed connectors.

The surface of the connector element 4 facing away from the power bar 6 comprises in a frontal section 9 a creepage power extension. The creepage power extension 10 is embodied as an alternating tongue and groove-like structure of the surface of the connector element 4 facing away from the power line 6. As discernible from FIG. 1, the creepage power extension 10 embodied as alternating tongue and groove structures is embodied on the entire, thus the circumferential surface of the frontal section 9 of the connector element 4.

Further, the connector element 4 also comprises in a rear section 10 a tongue and groove-like structure, however the ratio of the depth of the groove in reference to the height of the tongue of the alternating tongue and groove-like structure is greater in the frontal section 9 of the connector element 4 than in the rear section 10 of the connector element 4.

In the area of the second terminal 3 adjacent to the wall 1 a snap element 12 is arranged such that the snap element 12 interacts with the connector element 4. As discernible from FIG. 1 and FIG. 2, the snap element 12 comprises at the surface facing the connector element 4 an alternating tongue and groove-like structure, with the groove and/or the tongue of the snap element 12 correspondingly contacting the tongue and/or the groove of the rear section 11 of the connector element 4.

As further discernible from FIG. 3, the snap element 12 according to this preferred exemplary embodiment of the invention extends into the area of the wall 1 so that in the area of the wall 1 the connector element 4 can be inserted at least partially into the snap element 12.

When the first terminal 2 and the second terminal 3 are connected to each other, preferably the connector element 4 contacts the snap element 12 such that only the rear section 11 of the connector element 4 contacts the snap element 12 so that the frontal section 9 of the connector element 4 comprising the creepage power extension 10, is not in contact with the snap element 12.

Due to the creepage power extension 10 of the electric connector terminal according to the invention a creepage current flowing between the power bar 6 and the wall 1 must pass a greater creepage distance than in electric connector terminals of prior art. In other words, the electric connector terminal according to the invention allows the impingement of the power bar 6 with higher voltages while complying with statutory air and creepage distances. Further, the air distance of the creepage current is increased by the electric connector terminal according to the invention because according to the preferred exemplary embodiment of the invention discernible from FIG. 3 the snap element 12 projects into the area of the wall 1.

As a result, an electric connector terminal is provided to guide a circuit through a wall 1, which allows the impingement with higher voltages and currents, because due to the creepage current extension no enlargement of the terminals 2, 3 is required.

The invention claimed is:

1. An electric connector terminal for guiding a circuit through a wall, the electric connector terminal comprising:

a first terminal mounted at a side of the wall; and a second terminal mounted at the other side of the wall;

wherein the first terminal includes a connector element to connect to the second terminal, the connector element being inserted into the second terminal, wherein the second terminal includes a power line for an electric connection to the first terminal, the power line being inserted into the connector element, wherein the surface of the connector element facing away from the power line includes a creepage power extension, wherein the creepage power extension comprises an alternating tongue and groove-like structuring of the surface of the connector element facing away from the power line, and wherein the depth of the groove of the alternating tongue and groove-like structuring being greater in a frontal section of the connector element than in a rear section of the connector element.

2. An electric connector terminal according to claim 1, wherein in case the first terminals and second terminals being connected to each other at least the frontal section of the connector element being inserted into the second terminal.

3. An electric connector terminal according to claim 1, wherein in the frontal section of the connector element the entire surface of the connector element facing away from the power line comprising an alternating groove like and tongue like structuring.

4. An electric connector terminal according to claim 1, wherein the second terminal comprises a snap element to interlock the connector element, the snap element being able to counteract the connector element, and the snap element being arranged at the area of the second terminal adjacent to the wall.

5. An electric connector terminal according to claim 4, wherein the connector element is inserted at least partially into the snap element in the area of the wall.

6. An electric connector terminal according to claim 4, wherein the first terminal and the second terminal being connected to each other and the frontal section of the connector element being inserted through the snap element into the second terminal such that only the rear section of the connector element contacts the snap element at least partially.

7. An electric connector terminal according to claim 4, wherein in case the first terminal and the second terminal are connected the surface of the snap element inserted into the connector element comprising at least partially an alternating tongue and groove-like structure and the groove and the tongue of the snap element correspondingly contact the tongue and groove of the rear section of the connector element.

8. An electric connector terminal according to claim 1, wherein the connector element comprises a rectangular profile.

9. An electric connector element according claim 1, wherein the first terminal comprises a first connector, the second terminal, a second connector, and the power line being connected to at least one of the first connector and the second connector, and the power line being connected to at least one of the second connector and the first connector in a detachable fashion.

10. An electric connector terminal according to claim 9, wherein a detachable connection of the power line to at least one of the first connector and the second connector can be created by way of clamping.

11. An electric connector terminal according to claim 9, with the first connector and/or the second connector being embodied as screw connectors.

* * * * *